US007597541B2

(12) United States Patent
White

(10) Patent No.: US 7,597,541 B2
(45) Date of Patent: Oct. 6, 2009

(54) CENTRIFUGAL FAN ASSEMBLY

(75) Inventor: Robert White, Roslindale, MA (US)

(73) Assignees: Robert Bosch LLC, Broadview, IL (US); FIME S.p.A., Castelfidardo (IT)

( * ) Notice: Subject to any disclaimer, the term of this patent is extended or adjusted under 35 U.S.C. 154(b) by 335 days.

(21) Appl. No.: 11/334,219

(22) Filed: Jan. 18, 2006

(65) Prior Publication Data

US 2007/0014666 A1 Jan. 18, 2007

Related U.S. Application Data

(60) Provisional application No. 60/698,347, filed on Jul. 12, 2005.

(51) Int. Cl.
*F04D 29/44* (2006.01)
*F04D 29/40* (2006.01)

(52) U.S. Cl. ..... 416/183; 415/204; 415/206

(58) Field of Classification Search ..... 416/119, 416/183; 415/204, 119, 203, 205, 206
See application file for complete search history.

(56) References Cited

U.S. PATENT DOCUMENTS

| | | | | |
|---|---|---|---|---|
| 4,538,963 | A | 9/1985 | Sugio et al. | |
| 5,000,660 | A | 3/1991 | Van Houten et al. | |
| 5,026,251 | A | 6/1991 | Kinoshita et al. | |
| 5,964,576 | A | 10/1999 | Fujita et al. | |
| 6,340,291 | B1 | 1/2002 | Reckert | |
| 6,491,499 | B1 | 12/2002 | Marvin et al. | |
| 6,508,626 | B1 * | 1/2003 | Sakurai et al. | 416/180 |
| 6,554,574 | B1 | 4/2003 | Spaggiari | |
| 6,767,184 | B2 | 7/2004 | Kim et al. | |
| 2004/0219013 | A1 | 11/2004 | Hopfensperger | |

FOREIGN PATENT DOCUMENTS

| | | |
|---|---|---|
| DE | 345616 | 4/1921 |
| DE | 20309621 U | 10/2003 |
| EP | 0516073 | 12/1992 |
| GB | 2337795 | 12/1999 |

OTHER PUBLICATIONS

European Search Report for EP 06 01 4332, dated Mar. 11, 2009, 4 pages.

* cited by examiner

*Primary Examiner*—Edward Look
*Assistant Examiner*—Dwayne J White
(74) *Attorney, Agent, or Firm*—Michael Best & Friedrich LLP

(57) ABSTRACT

The present invention provides a centrifugal fan assembly including a housing and a centrifugal fan. The centrifugal fan includes main blades, each including a suction surface, a pressure surface, a leading edge, and a trailing edge. The centrifugal fan also includes secondary blades, each including a suction surface and a pressure surface. Each main blade defines a mean line between the suction surface and the pressure surface, and a nose-tail line intersecting the main blade mean line at the leading edge and the trailing edge. Each secondary blade defines a mean line between the suction surface and the pressure surface. A portion of the secondary blade mean line is substantially parallel to the main blade mean line when superimposed, and a portion of the superimposed secondary blade mean line deviates from the main blade mean line in a direction toward the main blade nose-tail line.

13 Claims, 5 Drawing Sheets

CENTRIFUGAL FAN ASSEMBLY

RELATED APPLICATIONS

This application claims priority to U.S. Provisional Patent Application Ser. No. 60/698,347 filed on Jul. 12, 2005, the entire contents of which is incorporated herein by reference.

FIELD OF THE INVENTION

The present invention relates generally to centrifugal fan assemblies.

BACKGROUND OF THE INVENTION

Centrifugal fan assemblies typically include a centrifugal fan positioned in a scroll-shaped housing or volute. The housing typically includes an inlet through which air or gas is drawn by the centrifugal fan, and an outlet through which pressurized air or gas is discharged. Centrifugal fans typically include a plurality of blades that pressurize and/or accelerate an incoming axial airflow for discharge into a scroll portion of the housing. The blades are typically attached to a hub for rotation therewith. The hub typically defines an airflow surface on the base of the centrifugal fan to redirect the incoming axial airflow toward a radial direction for discharge into the scroll portion of the housing.

Centrifugal fan assemblies also typically include a tongue positioned in the scroll-shaped housing to separate the scroll-portion of the housing from a discharge portion of the housing, which includes the outlet. The tongue is typically positioned in close proximity to the centrifugal fan to guide the airflow exiting the centrifugal fan into the scroll portion of the housing and to separate off a portion of the airflow that entered the scroll portion.

SUMMARY OF THE INVENTION

Centrifugal fan assemblies often generate broadband and tonal noise during their operation. One source of objectionable noise or tones can include the configuration and the geometry of the blades themselves. As the centrifugal fan rotates, the individual blades generate discrete pulses of air or air jets causing "blade rate tones," which can contribute to the overall broadband noise of the centrifugal fan. The amplitude of the blade rate tones is dependent upon the configuration and geometry of the blades. Another source of objectionable noise or tones can include the configuration and geometry of the tongue. During operation of the centrifugal fan, the discrete pulses of air or air jets impinge upon the tongue and can contribute to the overall broadband and blade rate tone noise of the centrifugal fan assembly. Particularly, the overall broadband noise of the centrifugal fan assembly can be increased when an entire air pulse or air jet impacts a surface on the tongue oriented perpendicularly to the direction of flow of the air pulse or air jet.

Although it may not be possible to completely eliminate the broadband or blade rate noise generated by centrifugal fan assemblies during their operation, the level or amplitude of the noise may be reduced by altering the configuration or geometry of the blades and the tongue.

The present invention provides, in one aspect, a centrifugal fan assembly including a housing and a centrifugal fan positioned in the housing for rotation about a central axis. The centrifugal fan includes a plurality of main blades arranged about the central axis. Each main blade includes a suction surface, a pressure surface opposite the suction surface, a leading edge, and a trailing edge. The centrifugal fan also includes a plurality of secondary blades arranged about the central axis. Each secondary blade includes a suction surface and a pressure surface opposite the suction surface. Each main blade defines a main blade mean line between the suction surface and the pressure surface of the main blade, and a main blade nose-tail line intersecting the main blade mean line at the leading edge and the trailing edge of the main blade. Each secondary blade defines a secondary blade mean line between the suction surface and the pressure surface of the secondary blade. At least a portion of the secondary blade mean line is substantially parallel to the main blade mean line when the secondary blade mean line is rotated about the central axis to superimpose at least a portion of the secondary blade mean line on the main blade mean line. At least a portion of the secondary blade mean line deviates from the main blade mean line in a direction toward the main blade nose-tail line.

The present invention provides, in another aspect, a centrifugal fan assembly including a housing having a scroll portion, a discharge portion, and a tongue at least partially separating the scroll portion and the discharge portion. The tongue has a scroll-side surface, a discharge-side surface, and an intermediate surface between the scroll-side surface and the discharge-side surface. The centrifugal fan assembly also includes a centrifugal fan positioned in the housing for rotation about a central axis. The centrifugal fan includes a plurality of blades arranged about the central axis. Each blade includes a leading edge and a trailing edge opposite the leading edge. The trailing edges of the blades define an axial span between opposite ends of the trailing edges. No portion of the intermediate surface of the tongue within the axial span is parallel to the central axis.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
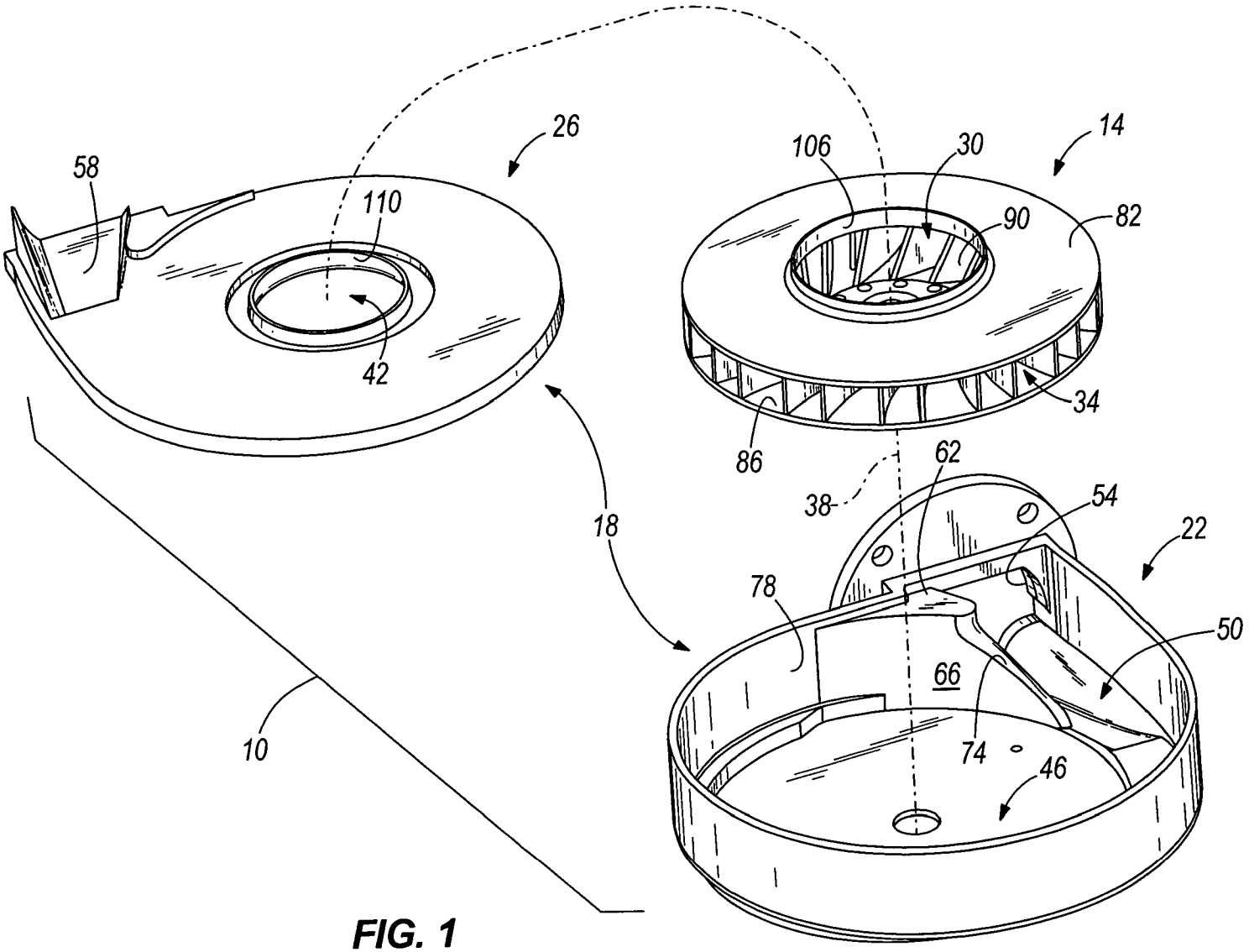
FIG. 1 is an exploded perspective view of a centrifugal fan assembly of the present invention, illustrating a centrifugal fan and a housing.

With reference to FIG. 1, a centrifugal fan assembly 10 including a fan wheel or a centrifugal fan 14 and a housing 18 is shown. The centrifugal fan assembly 10 may be used in residential heating systems to supply air or a mixture of gases to a residential boiler or combustion chamber. However, the centrifugal fan assembly 10 is not limited to this application, and may be used in other applications (e.g., automotive climate control systems). The housing 18 includes a generally scroll-shaped portion or volute 22 in which the centrifugal fan 14 is positioned, and a cover 26 for enclosing the volute 22. The centrifugal fan 14 includes an inlet 30 through which an axially-directed airflow is drawn and an outlet 34 through which a pressurized and/or accelerated airflow exits in a radial direction. As used herein, "airflow" may include any combination of gases or fluids.

The centrifugal fan 14 is rotatable in the housing 18 about a central axis 38. The cover 26 includes an inlet 42 through which an airflow is drawn by the centrifugal fan 14. As shown in FIG. 1, the inlets 30, 42 of the centrifugal fan 14 and the cover 26 are concentric. The volute 22 includes a scroll portion 46 in which the centrifugal fan 14 is positioned and a discharge portion 50 at least partially separated from the scroll portion 46. The discharge portion 50 includes an outlet 54 through which the pressurized and/or accelerated airflow exits. In the illustrated construction of the centrifugal fan assembly 10 shown in FIG. 1, the outlet 54 lies in a plane oriented substantially normal to planes defined by the inlets 30, 42. However, in alternative constructions of the centrifugal fan assembly 10, the outlet 54 may lie in a plane oriented substantially parallel to planes defined by the inlets 30, 42. Yet other constructions of the centrifugal fan assembly 10 may include an outlet 54 which lies in a plane oriented at an oblique angle to planes defined by the inlets 30, 42. Also, as shown in FIG. 1, portions 58 of the cover 26 extend into the discharge portion 50, when the cover 26 is coupled to the volute 22, to guide the pressurized and/or accelerated airflow through the discharge portion 50 toward the outlet 54.

The volute 22 also includes a tongue 62 at least partially separating the scroll portion 46 and the discharge portion 50. Particularly, the tongue 62 includes a scroll-side surface 66 that at least partially defines the scroll portion 46, a discharge-side surface 70 (see FIGS. 2 and 4) that at least partially defines the discharge portion 50, and an intermediate surface 74 between the scroll-side surface 66 and the discharge-side surface 70. The scroll-side surface 66 of the tongue 62 is positioned in close proximity to the outlet 34 of the centrifugal fan 14 to separate the pressurized and/or accelerated exiting airflow from upstream airflow passing through the scroll portion 46. In other words, the tongue 62 substantially prevents the re-introduction of pressurized and/or accelerated exiting airflow, which has already passed through the scroll portion 46, into the scroll portion 46.

Figure 2:
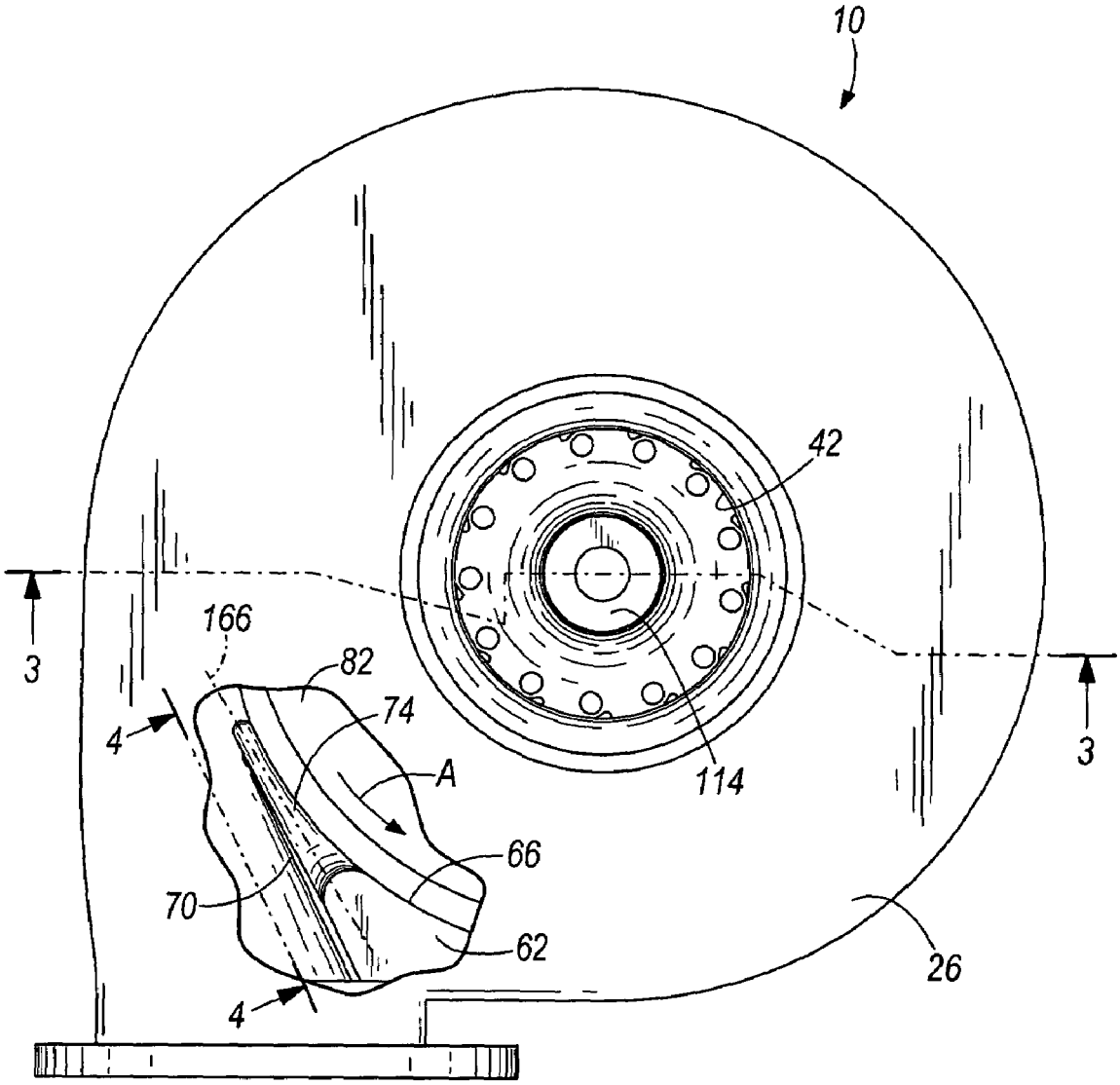
FIG. 2 is an assembled top view of the centrifugal fan assembly of FIG. 1.
Figure 3:
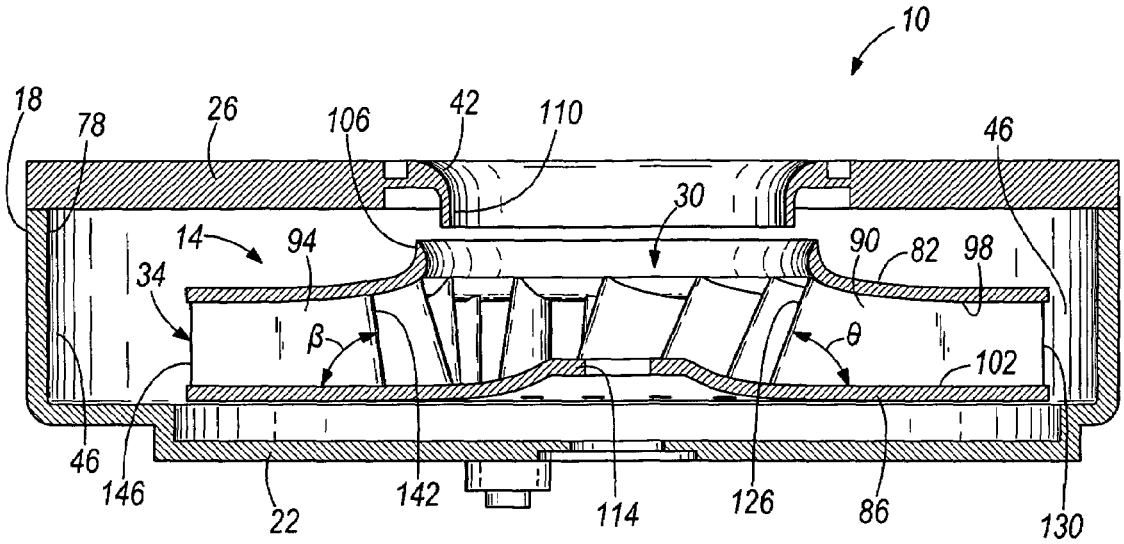
FIG. 3 is a cross-sectional view of the centrifugal fan assembly of FIG. 1 taken along line 3-3 in FIG. 2.

With reference to FIGS. 1-3, the scroll portion 46 defines a continuously increasing cross-sectional area, in a plane containing the central axis 38 or a plane orthogonal to the direction of rotation of the centrifugal fan 14 (indicated by arrow A in FIG. 2), progressing in the direction of rotation of the centrifugal fan 14. In other words, the space between the centrifugal fan outlet 34 and an inner wall 78 of the scroll portion 46 continuously increases, beginning at the tongue 62, progressing through the scroll portion 46 in the direction of arrow A, and ending generally at the transition between the scroll portion 46 and the discharge portion 50. The geometry of the cross-sectional area as defined by the scroll portion 46 can vary from elliptical to rectangular, and can include combinations of both shapes.

With reference to FIGS. 1-5, the centrifugal fan 14 includes a shroud plate 82 containing the inlet 30, a transmission plate 86 opposite the shroud plate 82, and a plurality of blades 90, 94 positioned between the shroud plate 82 and transmission plate 86. The shroud plate 82 and transmission plate 86 include respective guide surfaces 98, 102 for redirecting the incoming axial airflow to a substantially radial direction for discharge into the scroll portion 46.

With reference to FIG. 3, the shroud plate 82 includes an upstanding lip 106, which, in conjunction with an inwardly-extending lip 110 on the cover 26, substantially reduces the amount of airflow that re-enters the centrifugal fan 14 from the scroll portion 46. Although not shown in the drawings, the centrifugal fan 14 may be driven by a motor (e.g., an electric motor. The transmission plate 86 includes a central hub 114 (see FIGS. 2, 3, and 5) which may be coupled to an output shaft of the motor to drive the centrifugal fan 14.

Figure 5:
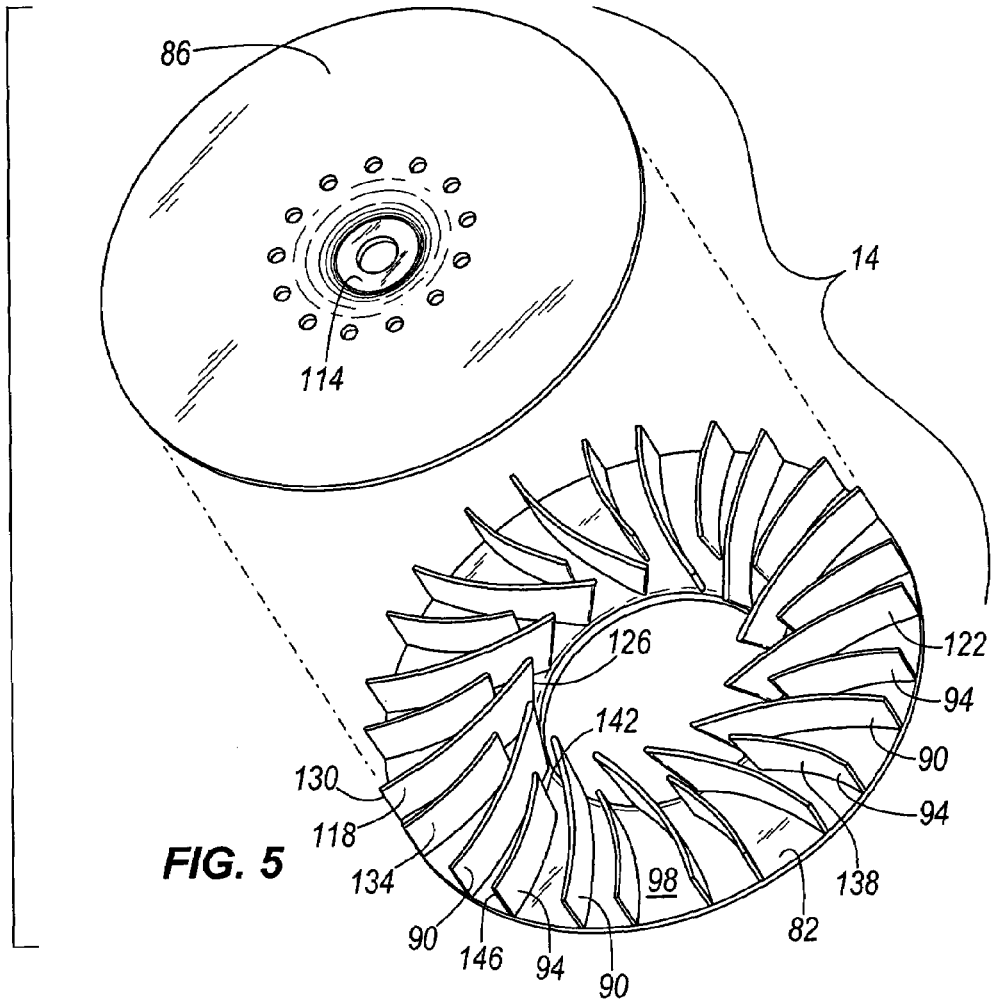
FIG. 5 is an exploded perspective view of the centrifugal fan of the centrifugal fan assembly of FIG. 1, illustrating a hub of the centrifugal fan removed to expose a plurality of main blades and splitter blades.
Figure 6:
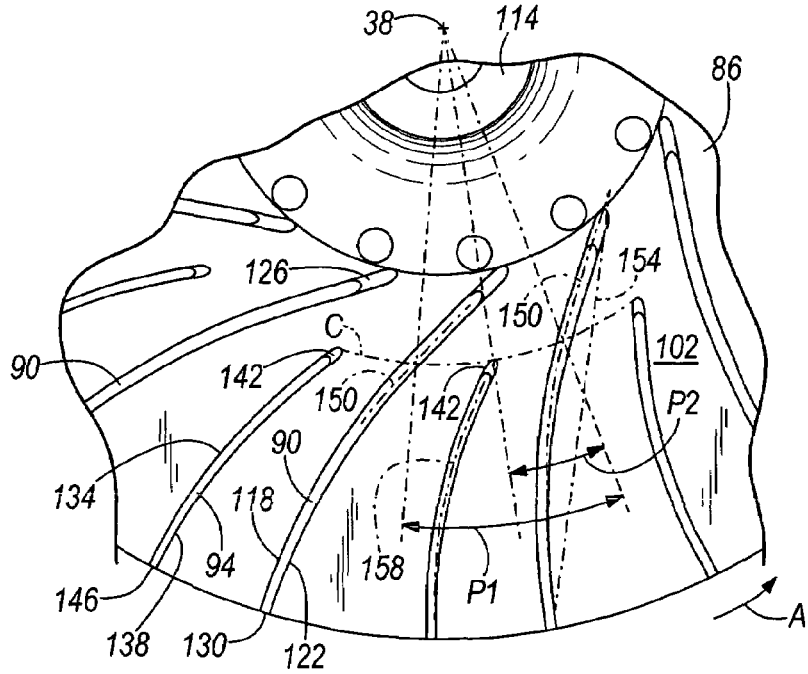
FIG. 6 is a partial top view of the centrifugal fan of the centrifugal fan assembly of FIG. 1, illustrating the plurality of main blades and splitter blades arranged on the hub, with the top shroud of the centrifugal fan removed.

With reference to FIGS. 5 and 6, the centrifugal fan 14 includes a plurality of two-dimensional main blades 90 arranged about the central axis 38 and a plurality of two-dimensional secondary or splitter blades 94 arranged about the central axis 38. The main blades 90 and splitter blades 94 are alternately spaced on the centrifugal fan 14, such that a single splitter blade 94 is positioned between adjacent main blades 90. However, alternate constructions of the centrifugal fan 14 may include more than one splitter blade 94 between adjacent main blades 90. Each of the main blades 90 includes a suction surface 118, a pressure surface 122 opposite the suction surface 118, a leading edge 126 adjacent the centrifugal fan inlet 30, and a trailing edge 130 adjacent the centrifugal fan outlet 34. Likewise, each of the splitter blades 94 includes a suction surface 134, a pressure surface 138 opposite the suction surface 134, a leading edge 142 spaced from the centrifugal fan inlet 30, and a trailing edge 146 adjacent the centrifugal fan outlet 34.

With reference to FIG. 3, the leading edges 126 of the main blades 90 are "swept back," or are swept in a direction away from the central axis 38 as the leading edges 126 extend from the transmission plate 86 to the shroud plate 82. In the illustrated construction of the centrifugal fan 14, the leading edges 126 of the main blades 90 form an angle $\theta$ of about 73 degrees with the guide surface 102 of the transmission plate 86, while the leading edges 142 of the splitter blades 94 form an angle $\beta$ of about 82 degrees with the guide surface 102 of the transmission plate 86. In alternate constructions of the centrifugal fan 14, however, the angle $\theta$ between the leading edges 126 of the main blades 90 and the guide surface 102 of the transmission plate 86 may be more or less than 73 degrees, and the angle $\beta$ between the leading edges 142 of the splitter blades 94 and the guide surface 102 of the transmission plate 86 may be more or less than 82 degrees.

With reference to FIG. 6, the main blades 90 are curved in the direction of rotation of the centrifugal fan 14, indicated by arrow A. The extent of the curvature of the main blades 90, otherwise known in the art as "camber," is measured by referencing a mean line 150 and a nose-tail line 154 of the main blades 90. As shown in FIG. 6, the main blade mean line 150 extends from the leading edge 126 to the trailing edge 130 of the main blade 90, half-way between the suction surface 118 and the pressure surface 122 of the main blade 90. The main blade nose-tail line 154 is a straight line extending between the leading edge 126 and the trailing edge 130 of the main blade 90, and intersecting the main blade mean line 150 at the leading edge 126 and the trailing edge 130 of the main blade 90.

Figure 7:
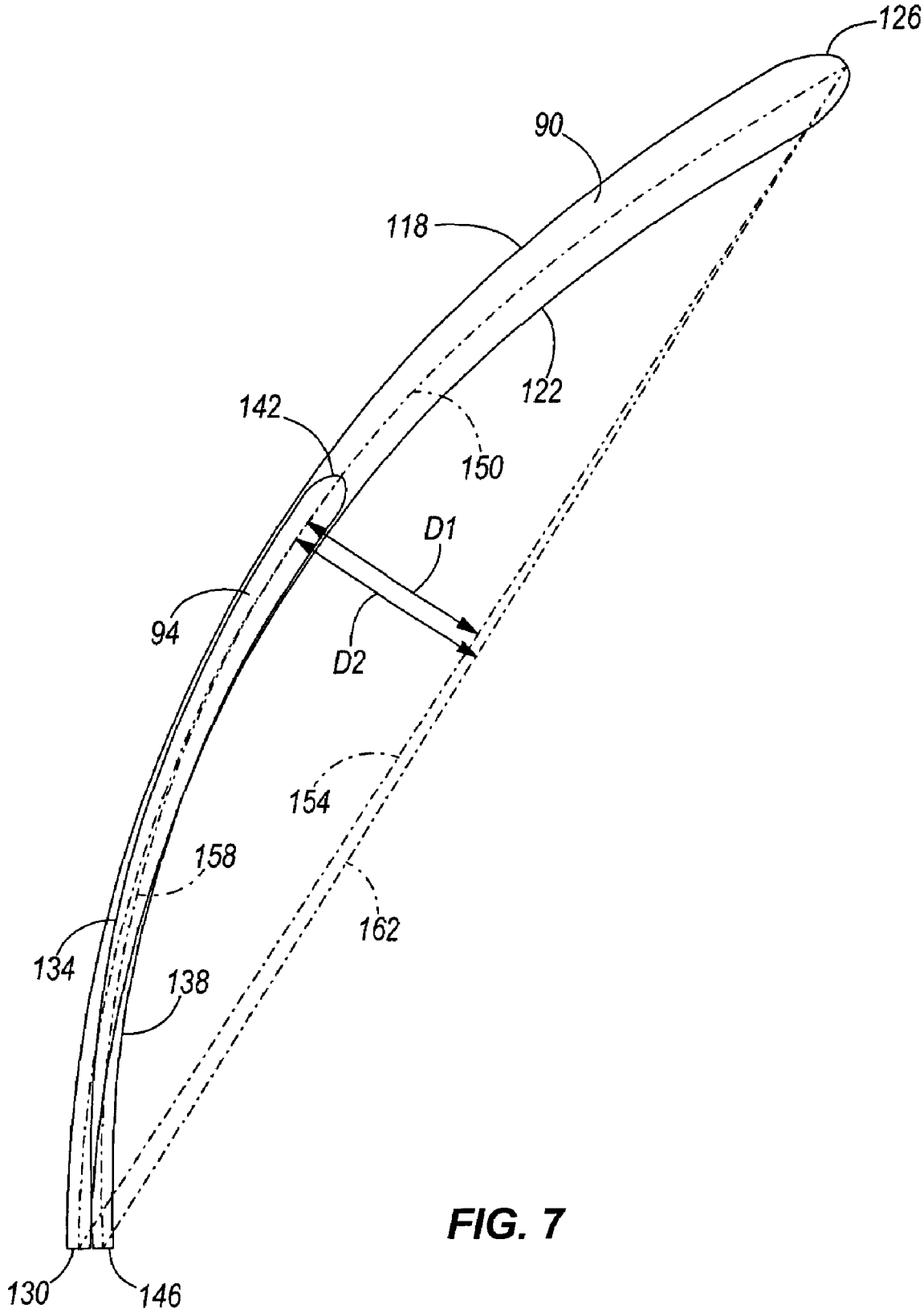
FIG. 7 is a top view of a splitter blade superimposed on a main blade, illustrating a difference in camber between the splitter blade and the main blade.

With reference to FIG. 7, camber is a non-dimensional quantity that is a function of position along the main blade nose-tail line 154. Particularly, camber is a function describing the perpendicular distance D1 from the main blade nose-tail line 154 to the main blade mean line 150, divided by the length of the main blade nose-tail line 154, otherwise known as the main blade "chord." Generally, the larger the non-dimensional quantity of camber, the greater the curvature of the main blade 90. In the illustrated construction of the centrifugal fan 14, the camber of the main blade 90, or the ratio of the perpendicular distance D1 to the length of the main blade nose-tail line 154, is about 0.14. In alternate constructions of the centrifugal fan 14, the camber of the main blade 90 may be more or less than about 0.14.

With continued reference to FIG. 6, the splitter blades 94 are also curved in the direction of rotation of the centrifugal fan 14, indicated by arrow A. However, the extent of the curvature of the splitter blades 94 is not measured independently of the main blades 90, using the procedure described above. Rather, the geometry of the splitter blades 94 is defined by the geometry of the main blades 90 because the splitter blades 94 are essentially "shortened" main blades 90. Like the main blades 90, each splitter blade 94 defines a mean line 158 extending from the leading edge 142 to the trailing edge 146 of the splitter blade 94, half-way between the suction surface 134 and the pressure surface 138 of the splitter blade 94. However, a nose-tail line is not drawn from the leading edge 142 of the splitter blade 94 to the trailing edge 146 of the splitter blade 94. Rather, the curvature of the splitter blades 94 is described in terms of the main blade nose-tail line 154, drawn as if the trailing edge 146 of the splitter blade 94 was the trailing edge 130 of the main blade 90.

With reference to FIG. 7, to describe the camber of the splitter blade 94 relative to the camber of the main blade 90, the shape of the splitter blade 94 is superimposed on the shape of the main blade 90. To do this, the splitter blade mean line 158 is rotated about the central axis 38 from its location shown in FIG. 6 to a location where at least a portion of the splitter blade mean line 158 near the leading edge 142 of the splitter blade 94 is superimposed on the main blade mean line 150. The splitter blade mean line 158 has a substantially parallel curvature to that of the main blade mean line 150, at least in the portion of the splitter blade mean line 158 near the leading edge 142, because the splitter blade 94 shares some of its geometry with the main blade 90.

As shown in FIG. 7, the camber of the splitter blade 94 is greater than the camber of the main blade 90 because the splitter blade mean line 158 deviates from the main blade mean line 150 in a direction toward the main blade nose-tail line 154. In other words, the splitter blade mean line 158 deviates from the main blade mean line 150 in the direction of rotation of the centrifugal fan 14 indicated by arrow A. To calculate the camber of the splitter blade 94, another nose-tail line 162 is drawn between the leading edge 126 of the main blade 90 and the trailing edge 146 of the splitter blade 94. This nose-tail line 162 is representative of the chord of the splitter blade 94, if the splitter blade 94 was not shortened and its leading-edge geometry was identical to that of the main blade 90. Further, a perpendicular distance D2 is measured from this nose-tail line 162 to the splitter blade mean line 158. The camber of the splitter blade 94 is then the ratio of the perpendicular distance D2 to the length of the new nose-tail line 162. In the illustrated construction, the camber of the splitter blades 94 is about 0.15. As such, the camber of the splitter blades 94 is about 7% greater than that of the main blades 90. In alternate constructions of the centrifugal fan 14, the camber of the splitter blades 94 may be more or less than about 7% greater than the camber of the main blades 90. Particularly, the camber of the splitter blades 94 may be at least about 1% greater than the camber of the main blades 90. Preferably, the camber of the splitter blades 94 is between about 6% and about 10% greater than the camber of the main blades 90.

With continued reference to FIG. 7, the increase in camber of the splitter blade 94 occurs smoothly within about the trailing 30% to about the trailing 50% of the length of the main blade nose-tail line 154. In other words, the deviation of the splitter blade mean line 158 from the main blade mean line 150 occurs along about the trailing 30% to about the trailing 50% of the length of the main blade nose-tail line 154. In the illustrated construction of the centrifugal fan 14, the increase in camber of the splitter blade 94 occurs smoothly over about the trailing 50% of the length of the main blade nose-tail line 154.

With reference to FIG. 6, the splitter blades 94 are positioned about the central axis 38 relative to the main blades 90 such that the splitter blades 94 are not precisely half-way between adjacent main blades 90. Rather, some of the main blades 90 are positioned closer than others to the splitter blades 94. As shown in FIG. 6, adjacent main blades 90 define a pitch or a pitch angle "P1" between respective main blade mean lines 154 of the adjacent main blades 90. The pitch angle P1 is measured along an arc C having a constant radius and centered on the central axis 38, in which the arc C passes through the leading edge 142 of the splitter blade 94 and intersects the splitter blade mean line 158 between the adjacent main blades 90. The splitter blade mean line 158 may be positioned relative to the next adjacent main blade mean line 150 in the direction of rotation of the centrifugal fan 14 (indicated by arrow A) to define a pitch angle "P2" between about 35% and about 47% of the pitch angle P1. In the illustrated construction of the centrifugal fan assembly 10, the pitch angle P2 is constant throughout the circumference of the centrifugal fan 14. However, alternative constructions of the centrifugal fan assembly 10 may include centrifugal fans 14 having varied pitch angles P2 throughout the circumference of the centrifugal fan 14, the varied pitch angles P2 ranging between about 35% and about 47% of the pitch angle P1.

In the illustrated construction of the centrifugal fan assembly 10, the pitch angle P1 between adjacent main blades 90 is constant throughout the circumference of the centrifugal fan 14. However, alternative constructions of the centrifugal fan assembly 10 may include centrifugal fans 14 having varied pitch angles P1 throughout the circumference of the centrifugal fan 14.

Figure 4:
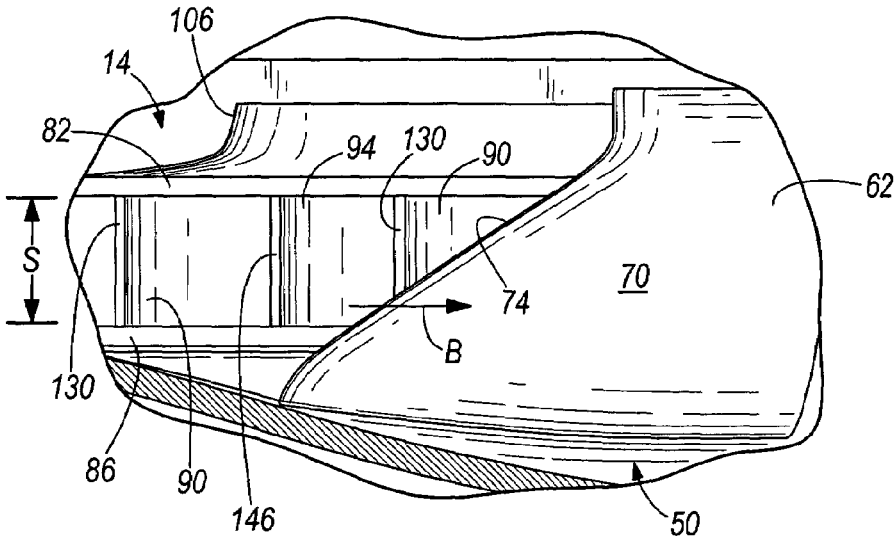
FIG. 4 is a cross-sectional view of the centrifugal fan assembly of FIG. 1 taken along line 4-4 in FIG. 2.

With reference to FIG. 4, the trailing edges 130, 146 of the main blades 90 and the splitter blades 94 define an axial span "S" between opposite ends of the trailing edges 130, 146. The entire portion of the intermediate surface 74 of the tongue 62 within the axial span S is curved in a plane 166 (see FIG. 2) passing through the tongue 62 between the scroll-side surface 66 and the discharge-side surface 70. Specifically, the intermediate surface 74 of the tongue 62 has a substantially hyperbolic curve in the plane 166 passing through the tongue 62 between the scroll-side surface 66 and the discharge-side surface 70. As shown in FIG. 4, no portion of the intermediate surface 74 within the axial span S is oriented perpendicularly to the direction of flow (indicated by arrow B) of the pressurized and/or accelerated airflow transitioning from the scroll portion 46 to the discharge portion 50. In other words, as shown in FIG. 4, no portion of the surface 74 within the axial span S is oriented parallel to the central axis 38, but rather the surface 74 curves upwardly within the axial span S from the transmission plate 86 to the shroud plate 82.

The combination of the features of the centrifugal fan assembly 10 described above, particularly the "swept-back" leading edges 126, 142 of the main blades 90 and splitter blades 94, the increased camber of the splitter blades 94 over the main blades 90, the offset pitch angle P2 of the splitter blades 94 relative to the main blades 90, and the curvature of the intermediate surface 74 of the tongue 62 within the span S, reduces the broadband noise and objectionable tones generated by the centrifugal fan assembly 10 and increases the efficiency of the centrifugal fan assembly 10. Although the illustrated centrifugal fan assembly 10 includes all of these features, alternate constructions of the centrifugal fan assembly 10 may include these features independently or any combination of these features to reduce the broadband noise and objectionable tones generated by the centrifugal fan assembly 10.

During operation of the centrifugal fan assembly 10, the geometry of the main blades 90 and splitter blades 94, specifically the increased camber of the splitter blades 94 over the main blades 90 and the offset pitch angle P2 of the splitter blades 94 relative to the main blades 90, yields a less pronounced blade rate tone by varying the pulses of air or air jets generated by the main blades 90 and splitter blades 94.

In addition, the geometry of the tongue 62, specifically the curvature of the intermediate surface 74 within the span S, reduces noise and objectionable tones by distributing the impact of the discrete air pulses or air jets on the curved intermediate surface 74 over time. By curving the intermediate surface 74 within the axial span S, the impact of the discrete air pules or air jets on the intermediate surface 74 is spread out over time, therefore reducing noise and objectionable tones by spreading out or blurring the frequency of the impacts.

Various features of the invention are set forth in the following claims.

I claim:

1. A centrifugal fan assembly comprising:

a housing;

a centrifugal fan positioned in the housing for rotation about a central axis, the centrifugal fan including a plurality of main blades arranged about the central axis, each main blade including a suction surface;

a pressure surface opposite the suction surface;

a leading edge; and a trailing edge;

a plurality of secondary blades arranged about the central axis, each secondary blade including a suction surface;

a pressure surface opposite the suction surface;

a leading edge; and a trailing edge;

wherein each main blade defines a main blade mean line between the suction surface and the pressure surface of the main blade;

a main blade nose-tail line intersecting the main blade mean line at the leading edge and the trailing edge of the main blade;

wherein each secondary blade defines a secondary blade mean line between the suction surface and the pressure surface of the secondary blade;

wherein at least a portion of the secondary blade mean line adjacent the leading edge of the secondard blade is substantially parallel to the main blade mean Line when the secondary blade mean line is rotated about the central axis to superimpose at least a portion of the secondary blade mean line on the main blade mean line; and wherein when the secondary blade mean line is superimposed on the main blade mean line, at least a portion of the secondary blade mean line adjacent the trailing edge of the secondary blade deviates from the main blade mean line in a direction toward the main blade nose-tail line.

2. The centrifugal fan assembly of claim 1, wherein the secondary blade mean line deviates from the main blade mean line within about the trailing 50% of the length of the main blade nose-tail line.

3. The centrifugal fan assembly of claim 2, wherein the secondary blade mean line deviates from the main blade mean line within about the trailing 30% of the length of the main blade nose-tail line.

4. The centrifugal fan assembly of claim 1, wherein deviation of the secondary blade mean line from the main blade mean line defines an increase in camber of the secondary blade relative to the camber of the main blade, and wherein the increase in camber is at least 1% greater than the camber of the main blade.

5. The centrifugal fan assembly of claim 4, wherein the increase in camber of the secondary blade relative to the camber of the main blade is between about 6% and about 10% greater than the camber of the main blade.

6. The centrifugal fan assembly of claim 1, wherein the main blades and secondary blades are alternately positioned on the centrifugal fan about the central axis.

7. The centrifugal fan assembly of claim 6, wherein adjacent main blades define a pitch angle between respective mean lines of the adjacent main blades, wherein the pitch angle is measured along an arc centered on the central axis and intersecting the secondary blade mean line at a leading edge of the secondary blade, and wherein the secondary blade mean line is positioned relative to the respective mean lines of the adjacent main blades between about 35% and about 47% of the pitch angle between the adjacent main blade mean lines.

8. The centrifugal fan of claim 7, wherein the secondary blade mean line is positioned relative to the mean line of the next adjacent main blade in a direction of rotation of the centrifugal fan between about 35% and about 47% of the pitch angle between adjacent main blade mean lines.

9. The centrifugal fan assembly of claim 1, wherein the fan wheel includes a transmission plate and a shroud plate opposite the transmission plate, wherein the shroud plate includes an inlet through which an airflow is drawn, and wherein the leading edges of the main blades are swept in a direction away from the central axis as the leading edges extend from the transmission plate to the shroud plate.

10. The centrifugal fan assembly of claim 9, wherein the leading edges of the secondary blades are swept in a direction away from the central axis as the leading edges of the secondary blades extend from the transmission plate to the shroud plate.

11. The centrifugal fan assembly of claim 1, wherein the housing includes a scroll portion, a discharge portion, and a tongue at least partially separating the scroll portion and the discharge portion, the tongue having a scroll-side surface, a discharge-side surface, and an intermediate surface between the scroll-side surface and the discharge-side surface, wherein the trailing edges of the main blades define an axial span between opposite ends of the trailing edges, and wherein no portion of the intermediate surface of the tongue within the axial span is parallel to the central axis.

12. The centrifugal fan assembly of claim 11, wherein an entire portion of the intermediate surface of the tongue within the axial span is curved in a plane passing through the tongue between the scroll-side surface and the discharge-side surface.

13. The centrifugal fan assembly of claim 12, wherein the intermediate surface of the tongue has a substantially hyperbolic curve in the plane passing through the tongue between the scroll-side surface and the discharge-side surface.

* * * * *

UNITED STATES PATENT AND TRADEMARK OFFICE

CERTIFICATE OF CORRECTION

PATENT NO. : 7,597,541 B2
APPLICATION NO. : 11/334219
DATED : October 6, 2009
INVENTOR(S) : Robert White It is certified that error appears in the above-identified patent and that said Letters Patent is hereby corrected as shown below:

Claim 1, Column 8, line 5:

change "adjacent the leading edge of the secondard blade is..." to --adjacent the leading edge of the secondary blade is...--.

Claim 1, Column 8, line 6:

change "parallel to the main blade mean Line when the..." to --parallel to the main blade mean line when the...--.

Signed and Sealed this

Twenty-ninth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,597,541 B2
APPLICATION NO. : 11/334219
DATED : October 6, 2009
INVENTOR(S) : Robert White It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 437 days.

Signed and Sealed this

Twenty-eighth Day of September, 2010

David J. Kappos

David J. Kappos
*Director of the United States Patent and Trademark Office*